United States Patent [19]

Orgass et al.

[11] Patent Number: 4,582,495

[45] Date of Patent: Apr. 15, 1986

[54] CONSTRUCTIONAL ELEMENT FOR DECORATIVE PURPOSES AND TOYS

[75] Inventors: Theodor Orgass; Reinhard Orgass; Rainer Mader, all of Hamburg, Fed. Rep. of Germany

[73] Assignee: Uexkull & Stolberg, Hamburg, Fed. Rep. of Germany

[21] Appl. No.: 648,135

[22] Filed: Sep. 7, 1984

[30] Foreign Application Priority Data

Sep. 14, 1983 [DE] Fed. Rep. of Germany ..... 3333097

[51] Int. Cl.[4] ..... A63H 33/08

[52] U.S. Cl. ..... 446/102; 446/120; 446/128; 446/415

[58] Field of Search ..... 446/117, 124, 128, 102

[56] References Cited

U.S. PATENT DOCUMENTS

| | | | |
|---|---|---|---|
| 3,324,619 | 6/1967 | Gearhart | 446/128 X |
| 3,487,579 | 1/1970 | Brettingen | 446/128 X |

FOREIGN PATENT DOCUMENTS

| | | | |
|---|---|---|---|
| 184497 | 1/1956 | Austria | 446/128 |
| 107924 | 12/1967 | Denmark | 446/128 |
| 1150976 | 1/1958 | France | 446/128 |
| 1256070 | 2/1961 | France | 446/128 |
| 50222 | 10/1966 | German Democratic Rep. | 446/128 |
| 629732 | 10/1961 | United Kingdom | 446/128 |
| 996811 | 6/1965 | United Kingdom | 446/128 |
| 1008459 | 10/1965 | United Kingdom | 446/128 |

*Primary Examiner*—F. Barry Shay

*Attorney, Agent, or Firm*—Cushman, Darby & Cushman

[57] ABSTRACT

A constructional element, which is suitable for decorative purposes or toys, comprises a box shaped member open at its base. On an outer top surface of the member are provided a row of pegs which have coaxially extending grooves. Clamping elements are provided within the member for engaging with the coaxially extending grooves on the pegs of another constructional element. Walls are also provided within the member which are connected to the top surface and the two side surfaces.

8 Claims, 4 Drawing Figures

CONSTRUCTIONAL ELEMENT FOR DECORATIVE PURPOSES AND TOYS

FIELD OF THE INVENTION

The invention relates to a constructional element for decorative purposes and toys.

BACKGROUND OF THE INVENTION

It is generally known to produce, for model constructional sets, constructional elements, of any desired shape, which comprise a substantially hollow plastic member in the form of a box which has no base and which is furnished, on its upwardly turned side, with connecting members for clamping on to the lower part, of the inwardly turned side surfaces, of other elements. By such co-operation one element is clamped on to another with adequate force, so that a number of constructional units thus assembled form a coherent structure, which can then be dismantled again by removing the individual elements.

Austrian Patent Specification No. 184 497 discloses a plastic constructional element, for decorative purposes and toys, comprising a member elongate in plan in the form of a box which is open at the base and which has disposed in a row in the longitudinal direction on its top side connecting members in the form of pegs tapering slightly conically upwards, and whose interior has two inwardly directed, perpendicularly extending clamping elements which are disposed on the inner surface of the side wall and can be moved into engagement with depressions in the pegs. The pegs formed with depressions are constructed in star shape, enabling the constructional units to be interconnected so that their longitudinal axes enclose angles different from 90°.

One disadvantage of this type of constructional element derives from the fact that when the angular position of the constructional units in relation to one another is altered, the upper unit must be removed from the peg of the subjacent unit and then replaced in the required position. The result is that there are no possible variations in turning a constructional unit once applied. Furthermore, this prior art constructional unit has no inner transverse walls. It is clamped via slightly conical ribs, disposed on the inside of the side wall and the also slightly conically extending flanks of the stellate jagged points of the peg. If the walls are too thin, or clamping takes place not only in the clamping zone of the flanks, but in the depressions of the stellate projections, the result is that the side walls of the unit bulge unattractively.

German Auslegeschrift No. 11 06 222 also discloses a non-rotatable plastic constructional element, comprising a member elongate in plan in the form of a box which is open at the bottom and whose top side has connecting members taking the form of cylindrical pegs extending in the longitudinal direction, its interior having inner walls extending from the cover member transversely of the longitudinal direction of the constructional element and are connected in one piece only to the cover member, but not to the side walls. The clamping principle of those constructional units is that the connecting members or pegs enter into clamping engagement with a resilient transverse wall, which is connected to the cover member, but not to the side walls of the box-shaped constructional unit and the particular end wall. A disadvantage of these toy constructional units is that they are very difficult to separate from one another, especially if the units are fairly large, and moreover they can be assembled only in alignment or transversely. The side walls do not bulge, however, since the resilient transverse wall is not connected to the side wall.

SUMMARY OF THE INVENTION

The invention solves the above problems by providing constructional elements of the kind specified which can be produced even in fairly large dimensions and are therefore suitable for decorative purposes and for use as supporting constructional elements. For example, they can be used as brackets and they can also be quickly and very simply assembled after the fashion of toys to produce small partitioned spaces or doll's houses, the individual constructional elements being reliably clamped, but nevertheless readily released from one another. The invention also provides constructional elements which can be assembled not only in alignment or perpendicularly to one another, but at given predetermined angles. More particularly, they can be rotated when a constructional unit has already been coupled to another constructional unit such turning being accompanied by the slight clicking sound of latching in. Specifically, the invention provides a clampable constructional unit on a novel clamping principle, which enables the units to be assembled reliably even with relatively thin wall areas, resulting in an appreciable saving of material, and more particularly shows no bulging of the side wall. Finally, the constructional element solving the aforementioned problems can be readily and very simply produced and satisfactorily shaped by injection moulding processes.

It has been discovered that a constructional element of the kind specified, which has a connecting member in the form of a cylindrical peg tapering slightly conically upwards, whose outer wall is formed with evenly spaced-out coaxially extending grooves, spaced-out webs being provided on each of the opposite side walls, not only enables the constructional elements to be extremely satisfactorily clamped, but allows the constructional elements to be moved into a well-defined angular position in relation to one another by suitable rotation after the web edges have latched into the corresponding grooves, in dependence on the number of grooves in each case. For example, a constructional unit having a peg formed with 16 grooves can be so assembled to another constructional unit that the wall surfaces form angles of 22.5° or a multiple thereof, such as 45° or 90°.

When clamped, not only do the particular pairs of webs yield resiliently slightly outwardly with the opposite side walls, but the edges of the webs are also forced apart, thus appreciably facilitating the assembly and dismantling of the clampable constructional units. To avoid excessive resilience of the side walls, the constructional elements according to the invention have a partition which extends transversely of the longitudinal direction of the element and is connected in one piece to the cover member and the side walls. In the constructional element according to the invention the partition has only one purpose, namely to prevent excessive resilience of the side walls; unlike the appreciably thicker partition in a prior art constructional element such as that, for example, disclosed in German Auslegeschrift No. 11 06 222, it does not act as an element which mainly effects the clamping in of the peg.

Of course, the peg can be formed with a different number of grooves such as, for example, 8 grooves, although the constructional elements can be assembled only at angles of 45°. On the other hand a substantially larger number of grooves can also be provided, so that the individual constructional elements can be adjusted only by extremely small angular increments, in order to obtain a precisely circular arrangement or an arrangement of other geometrical shapes.

Another advantage of the constructional element having a peg formed with grooves according to the invention is that when the elements are being assembled, attention is drawn to the angle selected by a "clicking" noise when the web edges latch into the grooves, and this can have a psychological and teaching effect, for example, if the constructional elements are used as toys.

BRIEF DESCRIPTION OF THE DRAWINGS

The invention will now be explained in greater detail with reference to the drawings, wherein.

DETAILED DESCRIPTION OF THE INVENTION

Figure 1:
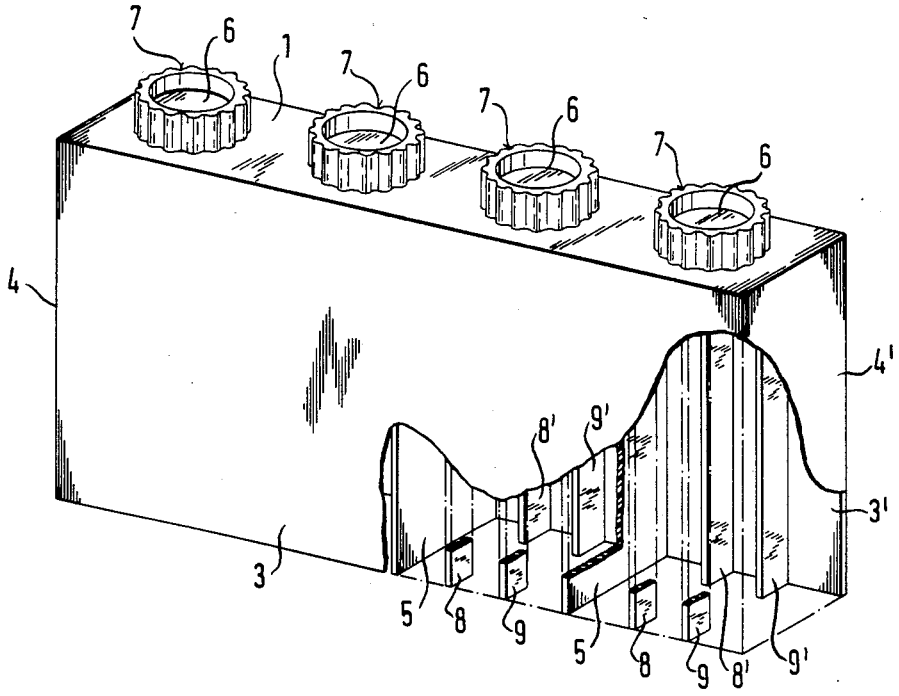
FIG. 1 is a perspective view of a constructional element according to the invention, with its front corner cut away.
Figure 2:
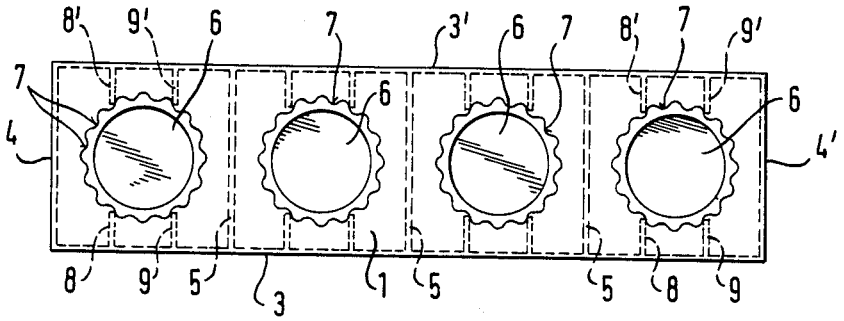
FIG. 2 is a plan view of a constructional element as illustrated in FIG. 1.
Figure 3:
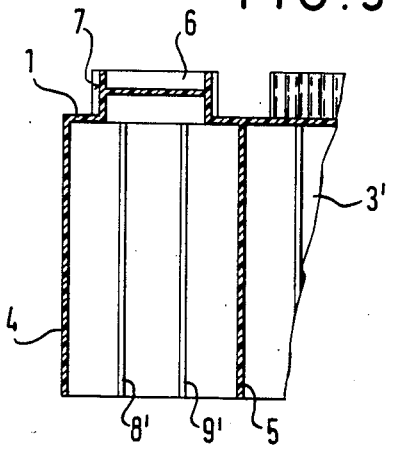
FIG. 3 is a vertical partial section through a constructional element as illustrated in FIG. 1.
Figure 4:
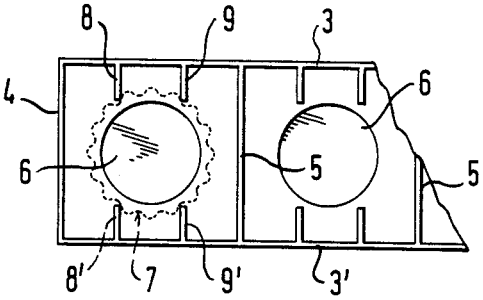
FIG. 4 is a partial view from below of a constructional element as illustrated in FIG. 3.

The constructional element illustrated in the drawings comprises a top horizontal cover member 1, two side walls 3 and 3' and two end walls 4 and 4', and also inner walls 5, which are connected in one piece to the cover member 1 and the side walls 3 and 3'. In this embodiment a peg 6 is formed tapering slightly conically upwards and with twelve circumferentially disposed grooves 7 into which the ends of webs 8 and 9 and of opposite webs 8' and 9' (as shown in FIG. 4) engage by clamping. In this embodiment the distance between the webs 8 and 9 is such that the inner edges of the webs engage in two grooves, which are disposed separated from one another by three corresponding projections and two grooves therebetween.

In the constructional element according to the invention all the walls, webs and sheets are made in one piece from a plastic, such as polyethylene or polystyrene. Of course, the individual constructional elements can be formed in most other various ways. For example, the pegs can be solid or hollow pegs, to save material; so-called partially hollow pegs are preferred, namely hollow cylindrical elements whose base area lies above the cover plate 1, this being advantageous for injection moulding reasons and to improve stability.

The dimensions of the constructional elements can range from the ordinary size of a child's toy up to, for example, brick size. Preferably the minimum size of the constructional element, i.e., the cover member basic surface to be associated with each pin, is about 3×3 cm with a wall height of about 8 cm. In that case the wall thicknesses are 0.3 to 1.0 mm or more.

What is claimed is:

1. A plastic constructional element for decorative purposes and toys, comprising:

a box-shaped member having a top wall, two side walls, and two end walls, each one of said walls having an outward and an inward face, and said member having an opening in its base opposite to said inward face of said top wall;

means for connecting said constructional element to another such constructional element such that connected constructional elements may be ratcheted to a plurality of angular positions relative to each other, said connecting means including:

a plurality of extending clamping elements disposed perpendicularly to said two side walls forming a pair of opposite webs disposed transversely of the longitudinal direction of the constructional element, each one of said plurality of perpendicularly extending clamping elements being connected to said inward face of said top wall and to said inward face of only one of said two side walls and yielding slightly resiliently outwardly;

partition walls provided within said box-shaped member being connected in one piece to said inward faces of said top wall and two side walls; and a plurality of pegs arranged in a row along the longitudinal direction of said outward face of said tip wall for connecting said plastic constructional element to another plastic constructional element, said pegs projecting into the opening of said another plastic constructional element when connected thereto, said pegs being cylindrically shaped and each having an outer wall formed with circumferentially evenly spaced-out extending grooves, said grooves being rounded and extending along axes parallel to the axis of said peg, wherein the width and spacing of the pair of opposite webs being such that the edges of the webs furthest from said inward faces of said top and side surfaces engage with said another plastic constructional element by clamping into the extending grooves in the pegs of said another constructional element.

2. A plastic constructional element according to claim 1, characterized in that the minimum size of the constructional element includes a top surface of 3×3 cm. and a side height of about 8 cm.

3. A plastic constructional element according to claim 1, characterized in that the pegs are each formed with sixteen grooves.

4. A plastic constructional element according to claim 3, characterized in that the pegs are constructed as partly hollow pegs.

5. A plastic constructional element according to claim 4, characterized in that the minimum size of the constructional element includes a top surface of 3×3 cm. and a side height of about 8 cm.

6. A plastic constructional element according to claim 3, characterized in that the minimum size of the constructional element includes a top surface of 3×3 cm. and a side height of about 8 cm.

7. A plastic constructional element according to claim 1, characterized in that the pegs are constructed as partly hollow pegs.

8. A plastic constructional element according to claim 7, characterized in that the minimum size of the constructional element includes a top surface of 3×3 cm. and a side height of about 8 cm.

* * * * *